United States Patent [19]

Ohara

[11] 4,195,581

[45] Apr. 1, 1980

[54] MECHANISM FOR MOVING WORK FABRIC FOR EMBROIDERING BY A SEWING MACHINE

[75] Inventor: Naoki Ohara, Toyota, Japan

[73] Assignee: Aisin Seiki Kabushiki Kaisha, Kariyashi, Japan

[21] Appl. No.: 6,883

[22] Filed: Jan. 25, 1979

[30] Foreign Application Priority Data

Feb. 1, 1978 [JP] Japan ..... 53-10690

[51] Int. Cl.[2] ..... D05C 9/04

[52] U.S. Cl. ..... 112/103; 112/121.12

[58] Field of Search ..... 112/103, 102, 121.22, 112/121.15, 121.12, 148, 119, 90, 86; 90/13 C; 74/25, 45, 48, 50

[56] References Cited

U.S. PATENT DOCUMENTS 875,626 12/1907 Parkes ..... 112/103

1,201,924 10/1916 Berry ..... 112/103

FOREIGN PATENT DOCUMENTS 460339 4/1973 U.S.S.R. ..... 112/103

OTHER PUBLICATIONS

Noell, et al. Tandem Scotch Yoke Assembly, IBM Technical Disclosure Bulletin, vol. 2, No. 5, Feb. 1960.

*Primary Examiner*—Werner H. Schroeder
*Assistant Examiner*—Andrew M. Falik
*Attorney, Agent, or Firm*—Oblon, Fisher, Spivak, McClelland & Maier

[57] ABSTRACT

A mechanism equipped with a plurality of crank and slotted cross-head assemblies which provides for a movement after a designed pattern by giving the work fabric holding frame two distinct rectilinear movements in right angled directions dependent upon respective controllings of the rectilinear movements.

7 Claims, 5 Drawing Figures

MECHANISM FOR MOVING WORK FABRIC FOR EMBROIDERING BY A SEWING MACHINE

BACKGROUND OF THE INVENTION

1. Field of the Invention

This invention relates to a sewing machine and particularly to a mechanism adapted for holding and moving a work fabric to be embroidered by the sewing machine after a designed pattern.

2. Description of the Prior Art

In some of the prior art fabric holding and moving mechanisms, a modeled mechanical movement of a fabric clamping frame was derived by the use of properly proportioned distinct servo motors in timed relation with a reciprocating needle of the sewing machine.

One of the conventional mechanisms, such as, for example, a mechanism having the known pantogroph type fabric supporting arm occupied too much space or was inconvenient in that it was associated with manufacturing difficulties and effected a rattle during its operation which was annoying to the operator.

In the other prior mechanisms, a movement to be imparted to a fabric clamping frame from one of the servo motors was derived under control by a polar coordinate type device. These conventional mechanisms were also inconvenient in that formation of a program for a specific frame movement was a complex operation.

SUMMARY OF THE INVENTION

The present invention avoids the drawbacks of the prior art devices briefly outlined above by placing the relatively small compact work fabric supporting frame contiguously to the bed of the sewing mechine head of the known type and by utilizing a controlling mechanism of which a program for controlling mechanical movements of the frame is easily formed.

According to the present invention, in a control mechanism of the above type, a pair of first crank and slotted cross-head mechanisms are joined to impart a rectilinear movement in one direction to a common work fabric supporting frame and a second crank and slotted cross-head mechanism is provided to impart another rectilinear movement to the common work fabric supporting frame at a right angle to the movement derived by the first crank and slotted cross-head mechanisms.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DESCRIPTION OF THE PREFERRED EMBODIMENT

Figure 1:
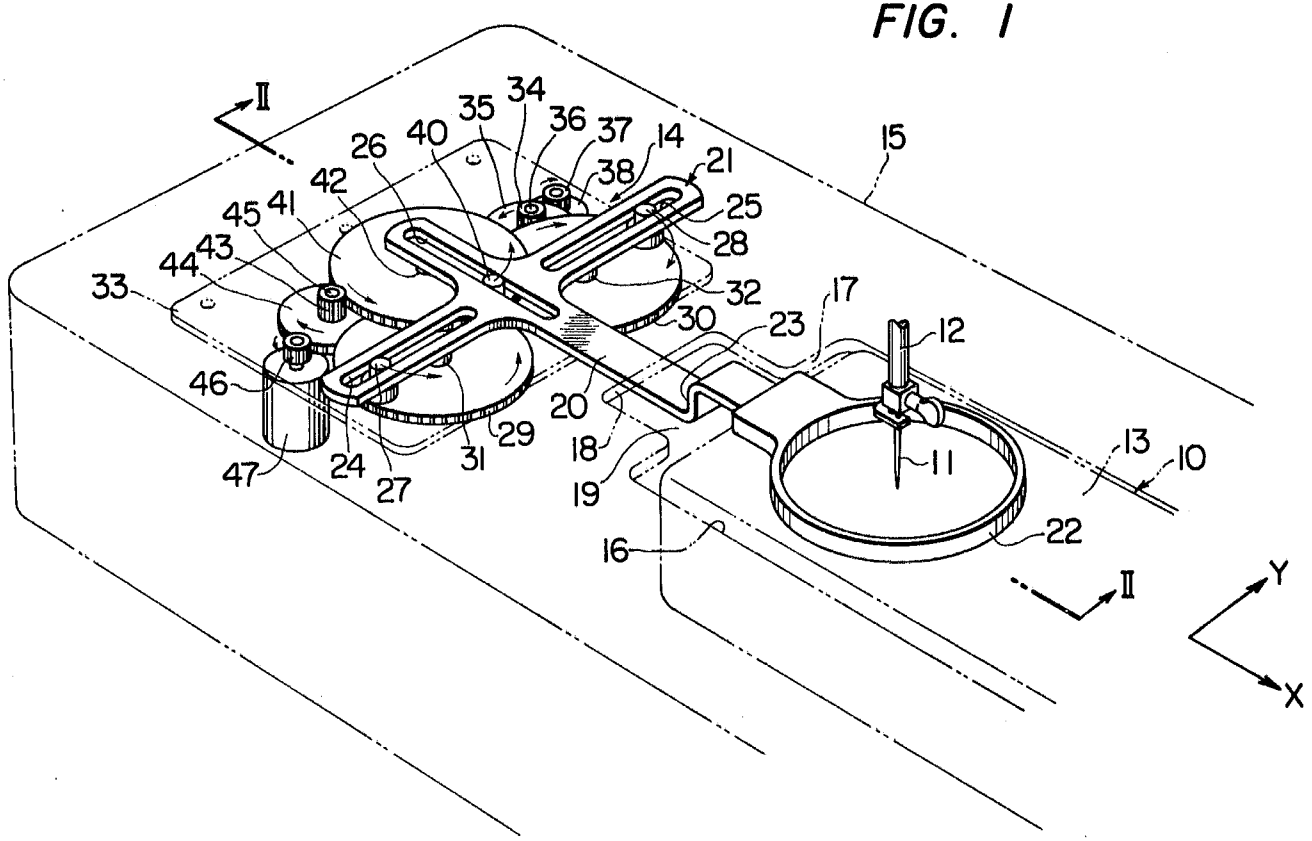
FIG. 1 is a perspective view of a controlling mechanism of the present invention with its associating parts partially shown.

The present invention is illustrated in the drawings as embodied in a well known and conventional sewing machine 10 that is herein illustrated and described only insofar as it is believed to be necessary for an understanding of the invention.

Mounted for reciprocation is a needle bar 12 adapted to support a needle 11 in a front upright (not shown) of a known sewing machine head partially shown in phantom. A controlling mechanism according to the present invention generally shown by the numeral 14 is covered by a table 15 shown in phantom. The table or cover 15 has a window 16 contoured to accomodate or suit a part of the periphery of the bed 13 except that an end portion 18 of the window 16 and a side edge 17 of the bed 13 cooperate to define an opening 19. Through the opening 19 horizontally extends a cranked arm 20 from a cross-head 21. At the extremity of the cranked arm 20 is carried a circular or ring form frame 22 adapted for supporting a work fabric in suitably tensioned condition. Attention should be drawn to the fact that a cranked portion 23 of the arm 20 provides means to carry the frame 22 outside of the table 15 while operatively connecting the frame 22 to the controlling mechanism 14 covered by the table 15. The bed 13 and cover 15 can be beneficially arranged with their faces lying in a horizontal plane adapted for supporting a wider fabric in position thereon.

Figure 2:
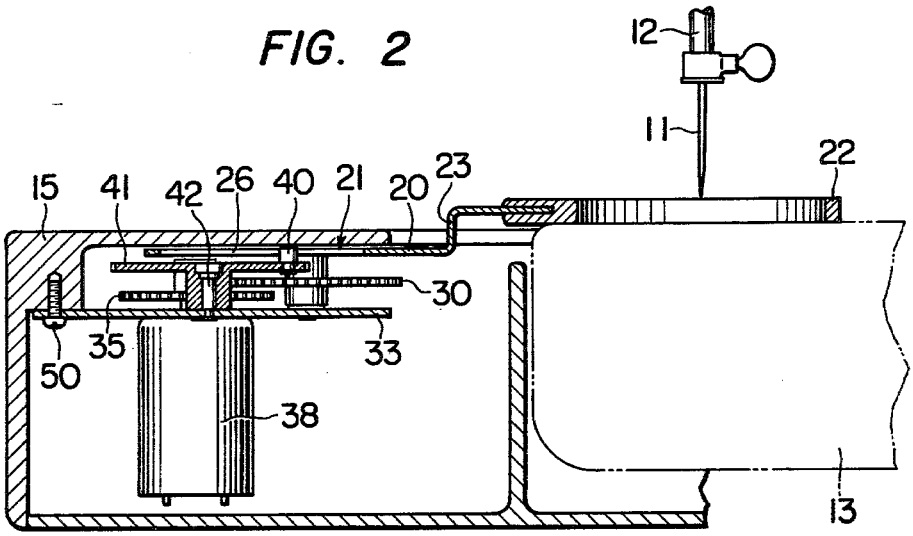
FIG. 2 is a cross sectional view taken along the line II—II in FIG. 1.

The cross-head 21 has a pair of vertical slots 24 and 25 and a horizontal slot 26. The horizontal slot 26 is at a right angle to the vertical slots 24 and 25. In the vertical slots 24 and 25, pins or studs 27 and 28 respectively have a sliding fit. The stud 27 is fast on a gear 29 and the other stud 28 is fast on another gear 30. Both gears 29 and 30 are respectively free to rotate about pins 31 and 32 projecting from a base plate 33 secured to the table 15 by means of screws 50 as shown in FIG. 2 (one of the screws 50 is shown in FIG. 2.) The gears 29 and 30 are of identical pitch diameter to have the same number of teeth, and mesh with each other in a manner such that the relative positions of the pins 27 and 28 are symmetric with respect to the meshing point which does not appear in the view but is inferable. It should be noted that both pins or studs 27 and 28 are apart the same distance from their revolving axes, respectively.

The gear 30 meshes with a pinion 34 which is concentrically rigidly coupled with a gear 35 free to rotate about a common pin 36 projecting from the base plate 33. The gear 35 in turn meshes with a pinion 37 secured on a driving shaft of a servo motor 38.

From the foregoing, it will be understood that the gears 29 and 30 are rotated by the servo motor 38 with a decreased speed due to the difference in the number of teeth in the gears of the gear train.

In the slot 26 another stud 40 is slidingly fit and secured to a gear 41 free to rotate about a pin 42 projecting from the base plate 33. The gear 41 meshes with a pinion 43 concentrically rigidly coupled with a gear 44 free to rotate about a common pin 45 projecting from the base plate 33. The gear 44 in turn meshes with a driving pinion 46 mounted on a driving shaft of another servo motor 47. When the servo motor 47 drives the pinion 46, the gear 41 is driven with a speed due to the difference in the number of teeth in the gears forming the gear train.

Operation

Figure 3:
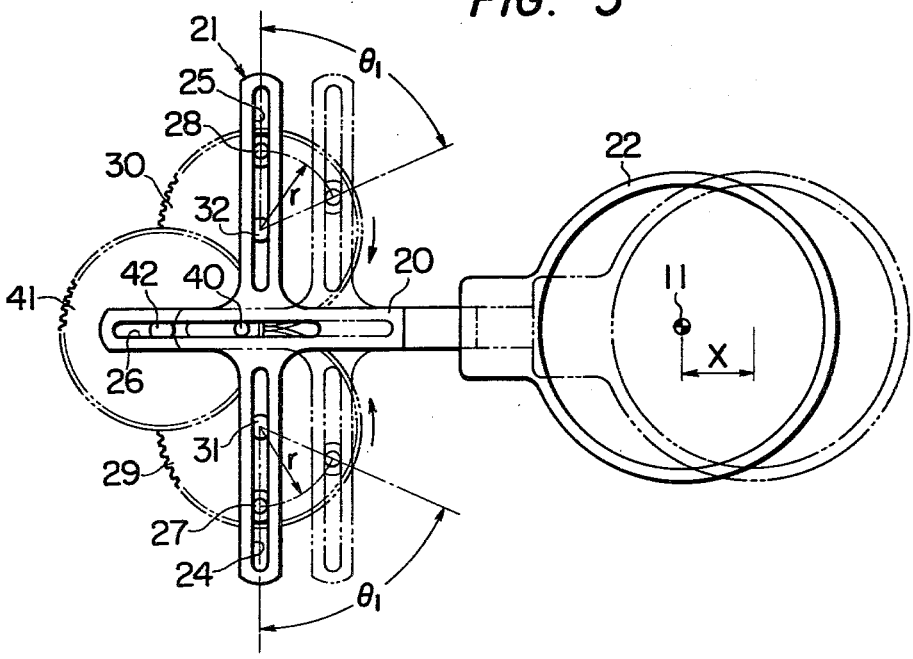
FIGS. 3 to 5 are plan views of the mechanism in FIG. 1 showing different mechanical movements derived by the mechanism.

When the gears 29 and 30 are rotated by the servo motor 38 through the gear train, both studs 27 and 28 describe respectively circular paths, as indicated by the arrows in FIG. 1, thus causing a rectilinear horizontal motion of the cross-head 21 as indicated by the reference character X in FIGS. 1 and 3.

Figure 4:
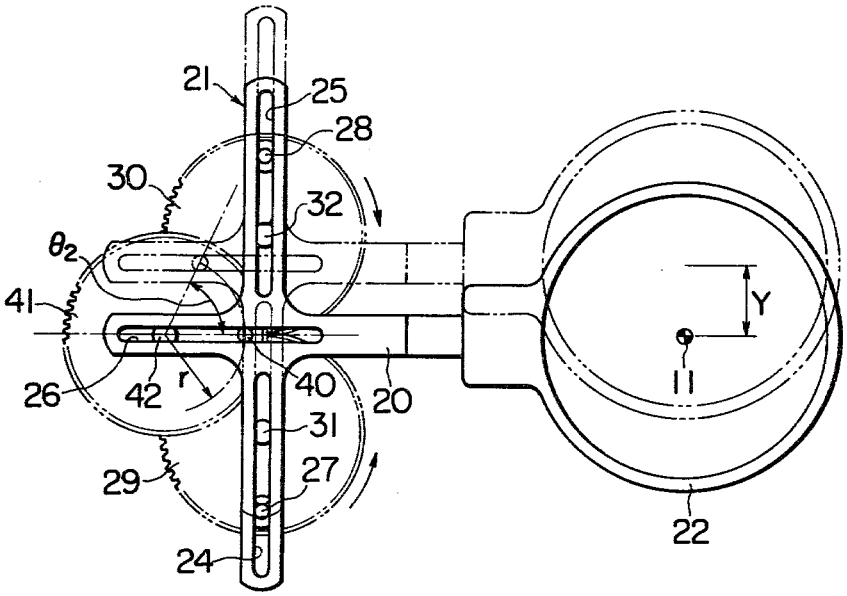

The cross-head 21 is also given a vertical rectilinear motion as the stud 40 revolves owing to the rotation of the gear 41 caused by the servo motor 47 through the gear train. The vertical rectilinear motion of the cross-head 21 is indicated in FIGS. 1 and 4 by the reference character Y.

From what has been thus far described, it will be understood that the cross-head 21 can be prevented from any tendency to rotate about an axis normal to the plane in which lies the frame 22 and hence the bed 13. This is apparently attributed to the fact that the gears 29 and 30 are of identical pitch diameter and both studs 27 and 28 are apart the same distance from the axes of their revolution. The symmetric relationship between the studs 27 and 28 at every point of their rotation also contributes to the eliminating of the rotation of the cross-head 21. However, the symmetric relationship is not always required, since one of the pins 31 and 32 can be displaced relative to the other along the horizontal direction designated by the character Y in FIG. 1 without failure of the eliminating of the rotational tendency of the cross-head 21.

Figure 5:
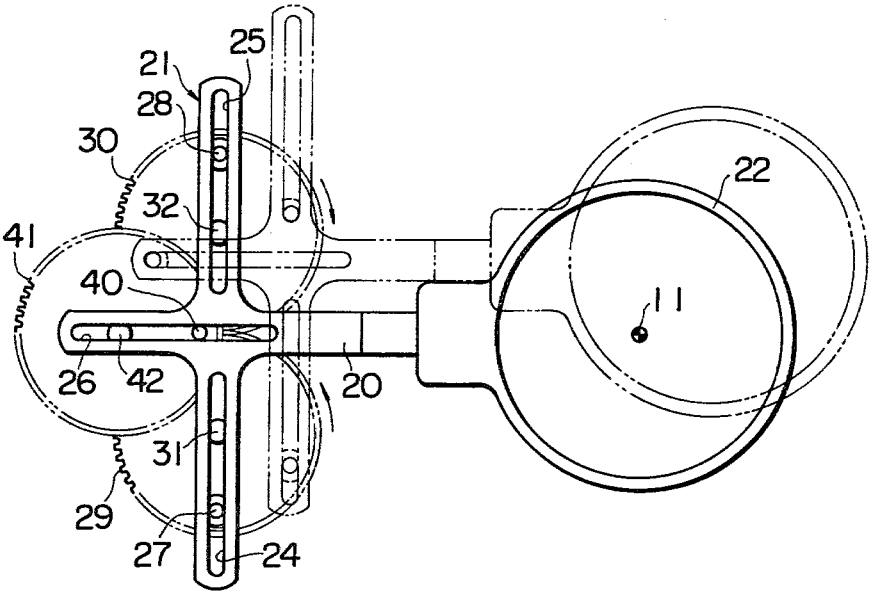

The mechanical movements of the above mentioned mechanism is based on the same general principles as those underlying a known "crank and slotted cross-head" or the so-called "Scotch Yoke". The distance which the studs 27 and 28 move and as measured in a horizontal direction will be the same as the horizontal movement of the cross-head 21 and hence the frame 22. In a similar manner, the distance which the stud 40 moves and as measured in a vertical direction is the same as the vertical movement of the cross-head 21 and hence the frame 22. Both vertical and horizontal movements are a harmonic motion. The horizontally measured movement of the cross-head 21 and hence the frame 22 is shown in enlarged scale in FIG. 3 as indicated by the character X. The vertically measured movement of the cross-head 21 and hence the frame 22 is also shown in enlarged scale in FIG. 4 as indicated by the character Y. In case of a simultaneous driving of the servo motors 38 and 47, the resultant complex movement of the cross-head 21 may be illustrated as shown in FIG. 5.

In practicing the invention, the servo motors 38 and 47 may be of, for example, so-called pulse motor (stepping motor) type. An electric control circuit is also needed to control rotation of the servo motors 38 and 47 distinctly so that the cross-head and hence the frame 22 are moved a distance horizontally and/or vertically for forming a modeled series of stitches on the work fabric after a designed pattern. The movement of the cross-head 21 and hence the frame 22 is synchronized with the reciprocating meedle 11 in order that the work fabric supported by the frame 22 may be fed when the needle 11 is in the retracted position from the fabric. Since selection of a type of the servo motors and the arrangement of the required electric controlling circuits do not form the present invention, description thereof is restricted to that only insofar as it is believed to be necessary for an understanding of this invention.

If the other types of electric motors are employed as the servo motors 38 and 47, a required controlling circuit may be of a type in which the horizontally and vertically measured movements of the cross-head 21 are both translated into exactly increase or decrease of electric potentials. Any types of potentiometer may be useful for sensing the potentials representing the vertical and horizontal movements of the cross-head 21 for the operator.

Since the horizontal and vertical movements of the cross-head 21 and the frame 22 are of a harmonic motion, the following consideration is believed helpful in practicing the invention.

In FIG. 3, the horizontal distance X which the cross-head 21 moves is represented as;

$$X = r \cdot \text{Sin}\ \theta 1,$$

where r = a radius of a circle described by the studs 27 and 28 when they are revolved as indicated by the arrows.

It will be understood from the above that the smaller the angle $\theta 1$ and the longer the radius r, the greater will be the rate of a straight-line movement of the cross-head 21 relative to the studs 27 and 28. Therefore, it will be concluded that in case of the small angle $\theta 1$ and the longer radius r, a necessary controlling electric circuit may beneficially be of a simpler and compact one, since the horizontal movement of the cross-head approxinates a uniform travel. During the revolution of the studs 27 and 28 beyond $\theta 1$ angle, the cross head 21 moves a distance which is less than that which the cross-head 21 has moved during revolutions of the studs 27 and 28 through the angle $\theta 1$. To this variation of movement, attention should be drawing in designing the mechanism 14, particularly the electric controlling circuit.

As shown in FIG. 4, the vertical distance Y which the cross-head 21 and hence frame 22 move is represented as;

$$Y = r \cdot \text{Sin}\theta 2,$$

where r = a radius of a circle described by the stud 40 when the stud is revolved as indicated by the arrow.

The same consideration as above will obtain in case of the stud 40. It should be noted that the radiuses shown in FIGS. 3 and 4 by the same reference character r are illustrated as being identical in length for illustration convenience inclusive of permissible discrepancy in lengths of the radiuses.

It will be understood from the foregoing that the small angles $\theta 1$ and $\theta 2$ and the longer radius r are preferred for designing a simpler controlling electric circuit owing to less variation of movement of the cross-head 21 for a uniform movement of the studs 27, 28 and 40. This has an important effect on the design of the control circuit. However, a program for controlling the movement of the cross-head 21 can be readily obtained throughout full circle of a revolution of the studs 27, 28 and 40 by precedingly experiencing a pure manual controlling of movement of the cross-head during a full revolution of the studs with the resultant timed relation between the studs and the cross-head measured for the subsequent mechanical controlling purpose.

From what has been thus far described, it will be noted that the invention provides a simpler mechanism for controlling the mechanical movement of the frame 22 without using any guiding or supporting device for the frame. This may be attributed to the dupplicate provisions of the same crank and slotted cross-head mechanisms for imparting a rectilinear movement to the frame in one direction. By using a stepped or shouldered stud such as is illustrated in FIG. 2 as at 40, all the studs 27, 28 and 40 can support the cross-head in a horizontal position as shown in FIG. 1 without being assisted by any other associating parts. This also contributes to strucurally simplifying of the the mechanism 14 of the invention.

What is claimed as new and described to be secured by Letters Patent of the United States is:

1. A mechanism adapted for holding and moving a work fabric to be embroidered by a sewing machine, including a pair of first crank and slotted cross-head mechanisms, each of said first crank and slotted cross-head mechanisms comprising a crank and a slot in a common cross-head, said crank of each of said first crank and slotted cross-head mechanisms being a sliding fit respectively in said slot of each of said first crank and cross-head mechanisms, said cranks being apart from revolution axes thereof at an identical distance from the axes respectively, said slots of said first crank and slotted cross-head mechanisms being in parallel with each other, a second crank and slotted cross-head mechanism, said second crank and slotted cross-head mechanism comprising a crank and a slot in said common cross-head, said crank of said second crank and slotted cross-head mechanism having a sliding fit in said slot thereof, said slot of said second crank and slotted cross-head mechanism being at right angle to said slots of said first crank and slotted cross-head mechanisms, a frame adapted for holding said work fabric in tensioned condition and being rigidly connected to said common cross-head, and means for attaching said mechanism contiguously to a bed of the sewing machine.

2. A mechanism as set forth in claim 1 wherein, two distinct servo motors are further comprised to recpectively drive the first crank and slotted cross-head mechanisms and the second crank and slotted cross-head mechanism.

3. A mechanism as set forth in claim 1 wherein, the said cranks of said first crank and slotted cross-head mechanisms are in symmetric relation with each other with respect to an intermediate point between the revolution axes of the cranks at every point in a revolution of each of the cranks.

4. A mechanism as set forth in claim 1 wherein, a cover is further comprised for covering the mechanism therewithin, said cover having a window, and the frame is connected by means of an arm to the said cross-head, said arm extending from the cross-head to the frame through the said window in freely movable condition in said window.

5. A mechanism as set forth in claim 4 wherein, the said arm has a cranked portion at an intermediate portion thereof, said cranked portion being disposed in said window, a portion of said arm between the cranked portion and the cross-head being housed by the cover and another portion between the cranked portion and the frame being revealed outside of the cover.

6. A mechanism as set forth in claim 4 wherein, the said window is defined partially by a portion of the said cover and partially by an edge of the said bed of the sewing machine.

7. A mechanism as set forth in claim 1 wherein, said crank of each of said crank and slotted cross-head mechanisms is diametrically reduced at a free end thereof to form a shoulder and said diametrically reduced portion is a sliding fit in said slot of each of said crank and slotted cross-head mechanisms, said shoulder of said crank of each of said crank and slotted cross-head mechanisms being in bearing relation with the cross-head.

* * * * *